US006838172B2

(12) United States Patent
Yoon et al.

(10) Patent No.: US 6,838,172 B2
(45) Date of Patent: Jan. 4, 2005

(54) SEA-ISLAND TYPED CONJUGATE MULTI FILAMENT COMPRISING DOPE DYEING COMPONENT AND A PROCESS OF PREPARING FOR THE SAME

(75) Inventors: Joon-Young Yoon, Kyungsangbuk-do (KR); Yoeng-Beek Choi, Daegu (KR)

(73) Assignee: Kolon Industries, Inc., Kyunggi-do (KR)

( * ) Notice: Subject to any disclaimer, the term of this patent is extended or adjusted under 35 U.S.C. 154(b) by 0 days.

(21) Appl. No.: 10/475,776

(22) PCT Filed: Apr. 26, 2002

(86) PCT No.: PCT/KR02/00777

§ 371 (c)(1),
(2), (4) Date: Dec. 4, 2003

(87) PCT Pub. No.: WO02/088438

PCT Pub. Date: Nov. 7, 2002

(65) Prior Publication Data

US 2004/0209077 A1 Oct. 21, 2004

(30) Foreign Application Priority Data

Apr. 26, 2001 (KR) ..... 2001-22592
Apr. 26, 2001 (KR) ..... 2001-22593

(51) Int. Cl.[7] ..... D01F 8/00
(52) U.S. Cl. ..... 428/370; 428/373; 428/374
(58) Field of Search ..... 428/370, 373, 428/374

(56) References Cited

U.S. PATENT DOCUMENTS 4,019,844 A 4/1977 Kikuchi et al.
4,350,006 A 9/1982 Nukushina et al.

FOREIGN PATENT DOCUMENTS

| | | | |
|---|---|---|---|
| JP | 51-48403 | A | 4/1976 |
| JP | 51-48404 | A | 4/1976 |
| JP | 01-14321 | A | 1/1989 |
| JP | 07-145514 | A | 6/1995 |
| JP | 10-60740 | A | 3/1998 |
| KR | 1996-0023310 | A | 7/1996 |

*Primary Examiner*—N. Edwards
(74) *Attorney, Agent, or Firm*—Birch, Stewart, Kolach & Birch, LLP

(57) ABSTRACT

The present invention relates to a dope dyed sea-island type conjugate multifilament. In the dope dyed sea-island type conjugate multifilament, which comprises easy soluble polymer as a sea component and polyester as an island component, the island component contains a dope dyed component selected from the group consisting of carbon black, pigments and dyestuffs and the temperature range (Tα–Tβ) showing more than 95% of the maximum thermal stress of yarns is from 120° C. to 210° C. The dope dyed sea-island type conjugate multifilament of the present invention has an excellent thermal shrinkage property and excellent wash fastness and light fastness, and the dyeing process thereof can be omitted after producing a woven or knitted fabric because a dope dyed component is contained in the island component (ultra fine yarn). The dope dyed sea-island type conjugate multifilament of the present invention is useful as yarns for warp knit fabrics used in production of women's apparel.

18 Claims, 1 Drawing Sheet

SEA-ISLAND TYPED CONJUGATE MULTI FILAMENT COMPRISING DOPE DYEING COMPONENT AND A PROCESS OF PREPARING FOR THE SAME

This application is the national 35 U.S.C. § 371 of PCT International Application No. PCT/KR02/00777 which has an International filing date of Apr. 26, 2002, which designated the United States of America.

BACKGROUND OF THE PRESENT INVENTION

Field of the Present Invention

The present invention relates to a dope dyed sea-island type conjugate multifilament and a process of preparing such conjugate multifilament which can improve light fastness and wash fastness when producing woven and knitted fabrics.

The sea-island type conjugate multifilament is produced by conjugate spinning a easy soluble polymer as a sea component and a fiber forming polymer as an island component into a sea-island type. It is mainly made for the purpose of producing an ultra-fine fiber. In other words, after producing the sea-island type conjugate multifilament, the sea component is dissolved by treating the multifilament with an alkali solution or the like to thus produce an ultra-fine fiber only composed of the island component.

In this way, as compared to a process of preparing a ultra-fine fiber by direct spinning, the process of preparing a ultra-fine fiber from the sea-island type conjugate multifilament has excellent spinning and drawing processability and can obtain a ultra-fine fiber of a finer denier. Meanwhile this method requires a process of dissolving and removing the sea component polymer using an organic solvent in a finishing process after weaving or knitting operations. Thusly it is very important for the sea component polymer to have a property of being easy soluble in an organic solvent or solution. Strength of yarn is also required.

Generally, the sea component polymer used for the sea-island type conjugate multifilament usually includes easy soluble copolymerized polyester. Because it is possible to dissolve the sea component using an alkali aqueous solution and weight reduction facility, which are widely used in weight reduction process of a general polyester fabric, without using an organic solvent, which needs a special apparatus and a lot of recovery cost.

In case that the island component polymer is nylon, upon dissolving of the sea component, the nylon is not degraded by the alkali aqueous solution very well, so the dissolution speed of the sea component is not very important. In case that the island component is polyester, because the polyester is weak to alkali, if the dissolution rate of the sea component is low, the island component is degraded before the sea component is completely dissolved, thus sharply reducing the yarn strength. Due to this, the raising property becomes poor and it is difficult to achieve a desired appearance and touch of a final product.

On the contrary, if the dissolution rate of the sea component is high, the above problems can be prevented and also alkali concentration and dissolution temperature and time can be reduced, thereby reducing the cost for dissolution and increasing productability.

DESCRIPTION OF RELATED ART

To solve the above problems, alkali easy soluble polyester used for producing a sea-island type conjugate multifilament is being produced by the following methods: first, a method of copolymerizing dimethylisophthalate sulfonate salt (hereinafter refer as "DMIS") or polyalkylene glycol (hereinafter refer as "PAG") of a low molecular weight during a polyester copolymerization; second, a method of blending polyester and PAG of a high molecular weight; and third, a method of copolymerizing and blending DMIS and PAG during a polyester copolymerization.

Usually, when producing a warp knit fabric using the above described sea-island type conjugate multifilament, a fabric that is warp knitted is raised in order to improve the touch and appearance of a final product. In the raising, a pile cutting shape should be uniform and constant and, after the raising, the uprightness of piles has to be excellent (the raising property and the stability of raising have to be excellent), so that the touch and appearance of a final product are made good.

However, the sea-island type conjugate multifilament produced by the conventional method has poor heat stability and yarns are excessively shrunken due to the heat generated by the friction between brushing wire and the sea-island type conjugate multifilament during the raising process, thus making the length of piles non-uniform and making it difficult to cut the raised piles.

Moreover, the sea-island type conjugate multifilament produced by the conventional method has to be additionally dyed in order to obtain a desired color when producing woven and knitted fabrics. This makes the process complicated and also the wash fastness and light fastness becomes poor after the dyeing.

To solve such problems, Korea Patent Application Laid-Open No. 1996-23310 discloses a method of mixing an organic pigment in an island component by melt-mixing (i) an island component chip with (ii) a master batch chip consisting of an island component base polymer; organic pigment, inorganic salt and polyethylene when producing a sea-island type multifilament.

However, in this method, the inorganic salt and polyethylene as well as the organic pigment has to be added when producing the master batch chip, thus increasing cost and, particularly, degrading physical properties such as thermal property of the island component due to the addition of polyethylene.

Meanwhile, Japan Patent Application Laid-Open No.1976-48403 and the same patent No. 1976-48404 disclose a process of preparing a suede-like sheet material impregnated with polyurethane resin by using a pigmented staple, which is produced by adding organic and/or inorganic pigment in conjugated spinning. However, in this method, since the organic and/or inorganic pigment is directly inputted into the island component polymer in conjugate spinning, the degree of dispersion is degraded.

Accordingly, it is an object of the present invention to provide a dope dyed sea-island type conjugate multifilament which has excellent heat shrinkage properties and can greatly increase various kinds of fastness in producing woven and knitted fabrics by containing a dope dyed component such as carbon black or the like uniformly in an island component of the sea-island type conjugate multifilament during a spinning operation.

SUMMARY OF THE PRESENT INVENTION

The present invention provides a dope dyed sea-island type conjugate multifilament which has an excellent heat shrinkage effect in subsequent process, can express a desired color without an additional dyeing process, and can increase wash fastness and light fastness greatly. In addition, the present invention provides a process of preparing a dope dyed sea-island type conjugate multifilament with excellent spinnability.

To achieve the above objects, the present invention provides a dope dyed sea-island type conjugate multifilament, which comprises easy soluble polymer as a sea component and polyester as an island component, wherein the island component includes a dope dyed component selected from the group consisting of carbon black, pigments and dyestuffs and the temperature range (Tα–Tβ) showing more than 95% of the maximum thermal stress of yarns is from 120° C. to 210° C.

The present invention will now be described in detail.

The dope dyed sea-island type conjugate multifilament comprises polyester as an island component, which includes a dope dyed component, and easy soluble polymer as a sea component.

As the dope dyed component, more than one component is used from the group consisting of carbon black, pigments and dyestuffs. If the carbon black is solely used, the ultra fine yarn (island component) has a black color. In case that the ultra fine yarn is desired to have other colors different from black, types of pigments or dyestuffs should be properly selected.

For example, the dyestuffs include solvent dyestuffs (products by Eastwell Co., Ltd.) such as Papilion Yellow S-4G, Papilion Red S-G, Papilion Blue S-GL, etc., and the pigments include BASF Corporation products such as Heliogen Blue D 7030, Paliogen Red L 3885, Paliotol Yellow D 1819 Heliogen, etc. By properly mixing these pigments and dyestuffs of RGB colors, a desired color can be obtained. Moreover, if the content of carbon black in the island component is adjusted to be less than 5% by weight, woven and knitted fabrics with grey color can be produced.

It is preferable to control the dope dyed component content to 0.1–15% by weight with respect to the weight of the island component. If the dope dyed component content is less than 0.1% by weight, the improvement effect of wash fastness and light fastness is small, or if it is more than 15% by weight, the spinnability is decreased.

Preferably, the average particle diameter of the dope dyed component contained in the island component is less than one-tenths of the diameter of the island component filament. Preferably, the average sectional area of the dope dyed component particle in the island component is less than one-twentieth of the filament cross-sectional area of the island component filament.

That is to say, in the sea-island type conjugate multifilament with a mono-filament fineness of 0.01 denier after dissolving the sea component, the diameter of the island component filament is 1.0 μm. In this case, it is preferable that the average particle diameter is less than 0.1 μm and the average cross-sectional area of the dope dyed component particle is less than 0.05 $\mu m^2$. If the average particle diameter and cross-sectional area of the dope dyed component in the island component are beyond the above range, the physical properties of yarn may be degraded greatly.

In case that the dope dyed component is dyestuffs, the dyestuffs is melted or dispersed up to the size of $10^{-9}$ m (Å) or so (monomolecular level), thus there is no need to specially limit the average particle diameter of the dyestuffs. Also, in case that the dope dyed component is carbon black which is a kind of inorganic pigment, the elementary particle diameter thereof is 2–3 nm or so. Therefore, there is no need to specially control the average particle diameter thereof. However, in case that the dope dyed component is organic or inorganic pigment which is non-easy soluble, the average particle diameter thereof needs to be controlled in the range of 0.001 μm–0.55 μm.

If the average particle diameter of the organic pigment is beyond the above range, the physical properties of yarn may be greatly degraded. The average area and average particle diameter of the dope dyed component particle in the island component filament can be measured by photographing the cross-section of the dope dyed sea-island type conjugate multifilament using a transmission electron microscope at a magnification of 1,000 times.

Meanwhile, the mono-filament fineness of the island component after dissolving the sea component is preferably 0.001–0.3 denier. If the mono-filament fineness is more than 0.3 denier, the feeling of touch may become hard and a writing effect may be decreased although the raising property and the durability of raised pile are improved. If it is less than 0.001 denier, the softness can be increased but raised pile easily fall out or are tangled due to friction, thus making the appearance poor. The number of island components in the dope dyed sea-island type conjugate multifilament is preferable 8 segment over.

Meanwhile, most preferably, copolymerized polyester with a very high alkali dissolution rate is used as the sea component in order to minimize yarn damage during a raising process by increasing the duration ratio of yarn (island component) strength after dissolving the sea component. More specifically, as the sea component, is used a blended composition of (i) copolymerized polyester containing an ester unit of ethylene terephthalate acid as a main constituent and an ester unit containing metal sulfonate and (ii) polyethylene glycol having a number average molecular weight of more than 8,000.

At this time, the copolymerized polyester content in the sea component is 80–90% by weight, and the polyethylene glycol content is more preferably 4–20% by weight. If the polyethylene glycol content is less than 4% by weight, the dissolution speed of the sea component, especially, the initial dissolution speed may be lowered. If it is more than 20% by weight, copolymerization may difficult.

The content of the ester unit containing metal sulfonate in the copolymerized polyester is preferably 3–15 mole %. If the above content is less than 3 mole %, the dissolution speed of the sea component is lowered and the island component may be invaded. If it is more than 15 mole %, it becomes amorphous polymer by on excessive does of a copolymerized compound, thus making spinning process difficult and increasing production cost. More preferably, the total amount of a copolymerized compound and a blended compound in the sea component is 20% by weight with respect to the total weight of the sea component.

The dope dyed sea-island type conjugate multifilament of the present invention can express more than 95% of the maximum thermal stress of the yarn within a temperature range (Tα–Tβ) of 120–210° C., more preferably, a temperature range (Tα–Tβ) of 130–200° C. As shown in FIG. 1, it is not possible to definitely determine the temperature showing the maximum thermal stress in view of a measuring method. Hence, in the present invention, the specific range showing more than 95% of the maximum thermal stress is selected.

At the temperature of the maximum thermal stress, the heat shrinkage power of the filament is the highest. Moreover, for most of the dope dyed sea-island type conjugate multifilament, the subsequent process are carried out in the above range. Thus, if the temperature range showing more than 95% of the maximum thermal stress of the yarn is smaller than the above range, an excessive shrinkage occurs to thus make it difficult to control the subsequent process. If it is larger than the above range, shrinkage is insufficient during the subsequent process and thus the volume and density of the fabric of the dope dyed sea-island type conjugate multifilament are degraded, thus making the appearance and touch of a final product poor.

In other words, if the temperature range ((Tα–Tβ) showing more than 95% of the maximum thermal stress of the yarn satisfies the range of 120–210° C. the above problems can be overcome. If the temperature range is below 120° C., the yarn is shrunk by a friction heat generated in raising, thus making the length of piles non-uniform and generating non-uniformly cut piles. Meanwhile, if the temperature range is above 210° C., a heat shrinkage effect is decreased in the subsequent process, and thus there generates a difference in thickness and touch of the fabric made from dope dyed sea-island conjugate multifilament.

As one example of producing an alkali easy soluble sea component of the present invention, polyethyleneterephthalate is copolymerized with DMIS of 3–15 mole %, and then polyethylene glycol of 4–20 weight %, whose number average molecular weight is more than 8,000, is added thereto, for thereby producing the sea component.

In addition, as the sea component, polyvinylalcohol, polystyrene or the like can be used. In case of using polystyrene, in order to dissolve the sea component, a solvent has to be used, which causes environmental contamination.

The dope dyed sea-island type conjugate multifilament of the present invention can be produced by conjugated spinning a polyester island component containing the dope dyed component and a easy soluble polymer sea component using an ordinary sea-island type conjugate spinning machine. At this time, the sea-island type conjugate multifilament can be produced by spinning direct drawing method at a high spinning speed, or the sea-island type conjugate multifilament of an undrawn or half-drawn state can be produced at a spinning speed of 1,500–3,500 m/min.

With regard to the methods of inputting a dope dyed component in the island component, the dope dyed component can be directly inputted into a main feed tube for the island component of a conjugate spinning machine, or a master batch chip, which is produced by mixing the island component with the dope dyed component in advance, is inputted into a sub feed tube for the island component of the conjugate spinning machine and then is mixed again with the island component, which is inputted into the main feed tube for the island component.

More preferably, however, when producing the sea-island type conjugate multifilament comprising easy soluble polymer as the sea component and polyester as the island component, the island component chip is fed into the main feed tube 1 of a sea-island type conjugate spinning machine, a master batch chip, which includes a dope dyed component of 5–50% by weight selected from the group consisting of carbon black, pigments and dyestuffs, is fed into the sub feed tube 2 for the island component of the sea-island type conjugate spinning machine, and then the island component chip and the master batch chip are melted and mixed at the inlet of a melt-extruding machine 3 for the island component.

Specifically, in the present invention, in order to disperse uniformly the dope dyed component in the island component, the dope dyed component is not directly inputted into the island component upon spinning but an ordinary island component chip and the island component chip containing the dope dyed component (hereinafter refer as "a master batch chip") are inputted respectively into the main feed tube and sub feed tube for the island component of the spinning machine, and then are melted and mixed at the exit of the melt-extruding machine of the island component, thus producing the island component containing the dope dyed component.

If the dope dyed component is not directly inputted into the island component but is inputted and mixed in the state of the master batch chip, the dope dyed component content in the island component becomes uniform and it is easy to set spinning conditions.

More specifically, since the master batch chip fed into the sub feed tube 2 has a smaller amount than the island component chip fed into the main feed tube 1, the spinning conditions are not much affected. Upon melt-mixing of the master batch chip in the melt-extruding machine 3 of the island component, a sufficient driving force is applied, which make it easy to set spinning conditions.

On the contrary, if the dope dyed component is directly inputted into the island component, this causes a change in physical properties such as the melt viscosity, inherent viscosity or the like of polymer upon copolymerization or conjugated spinning, thus making it difficult to set spinning conditions. Also, in case that there occurs a difference in gravity between the master batch chip and the island component chip, a difference in size between the chips and the like, the phenomenon of phase separation is easily occurred simply by physical factors, thereby making the concentration of the dope dyed component non-uniform.

Next, according to the present invention, the polyester island component containing the dope dyed component and the easy soluble polymer sea component are conjugated-spun by an ordinary sea-island type conjugate spinning machine. At this time, the sea-island type conjugate multifilament can be produced by spinning direct drawing method at a high spinning speed, or the sea-island type conjugate multifilament of an undrawn or half-drawn state can be produced at a spinning speed of 1,500–3,500 m/min. It is preferable to adjust the weight ratio of island component to 50–85% by weight and the weight ratio of sea component to 15–50% by weight.

When weaving a woven fabric or knitting a knitted fabric, the dope dyed sea-island type conjugate multifilament of the present invention is used as a warp and/or weft or used as a face yarn. Then the woven fabric or knitted fabric becomes extremely fine by means of weight reduction in an alkali solution and dissolving of the sea component in the dope dyed sea-island type conjugate multifilament.

The thusly produced woven fabric or knitted fabric contains the dope dyed component in the ultra-fine yarn (island component), so an additional dyeing can be omitted. However, in order to adjust the color of the woven fabric or knitted fabric, an additional dyeing process can be carried. In the additional dyeing process, a sufficiently deep color can be obtained even at a concentration of dyestuffs less than 3%.

Furthermore, the woven fabric or knitted fabric, which is made from the dope dyed sea-island type conjugate multifilament according to the present invention, contains the dope dyed component in the ultra-fine yarn (island component), thus their wash fastness and light fastness are very excellent. The dope dyed sea-island type conjugate multifilament of the present invention is useful for production of woven or knit fabrics for women's apparel.

Figure 1:
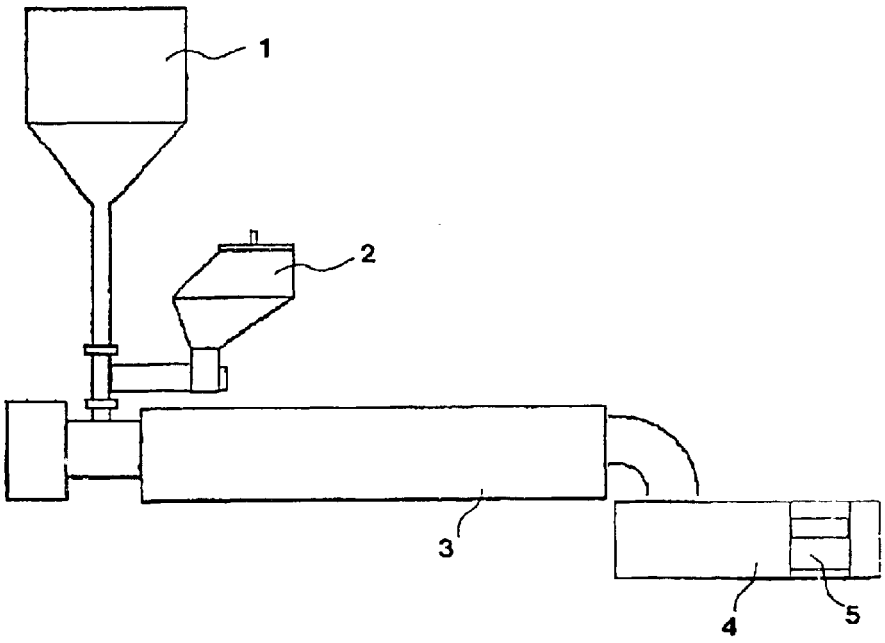
FIG. 1 is a schematic view of a process of producing a master batch chip.
Figure 2:
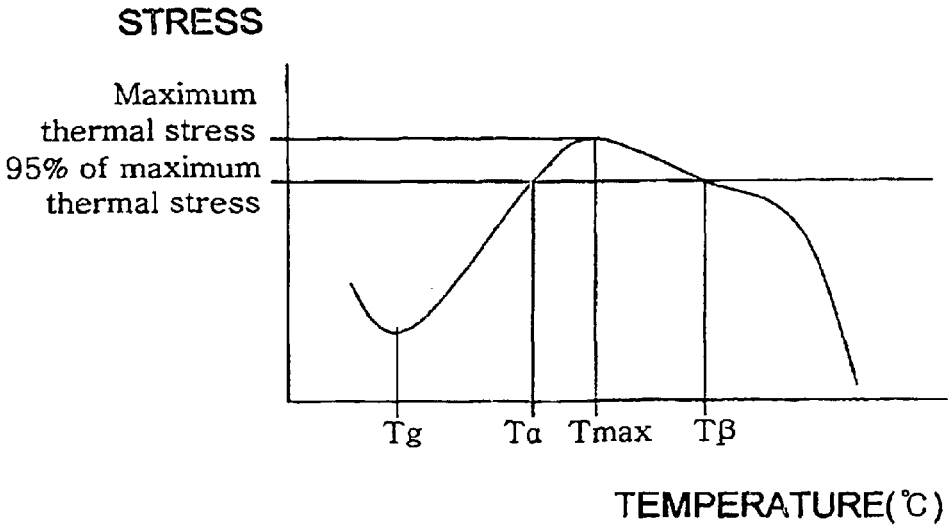
FIG. 2 is a thermal stress curve of a sea-island type conjugate multifilament according to the present invention, which was drawn by a thermal stress tester.

※ Reference numbers of main units in the drawings*

1: Main feed tube (main hopper)

2: Sub feed tube (side hopper)

3: Melt-extruding machine

4: Spinning block 5: spinneret

Tg: Initial shrinkage starting temperature of yarns

Tmax: Maximum thermal stress temperature of yarns

Tα: Lower limit of temperature range showing more than 95% of the maximum thermal stress TV: Upper limit of temperature range showing more than 95% of the maximum thermal stress

DETAILED DESCRIPTION OF THE EMBODIMENTS

The present invention is now understood more specifically by comparison between examples of the present invention and comparative examples. However, the present invention is not limited to such examples.

EXAMPLE 1

A master batch chip, which is composed of 20% by weight of carbon black and 80% by weight of polyethylene terephthalate having an intrinsic viscosity of 0.64, is fed into a sub feed tube for an island component of an ordinary sea-island type conjugate spinning machine, and at the same time an island component chip of polyethylene terephthalate having an intrinsic viscosity of 0.64 is fed into an main feed tube for the island component. Then; these are melted and mixed at the front end of a melt-extruding machine, thus producing a final island component and then feeding it to the sea-island type conjugate spinning machine continuously. At this time, the weight ratio of the master batch chip to the island component chip is adjusted so that the carbon black content in the final island component is 10% by weight. Meanwhile, alkali easy soluble copolymerized polyester composed of 5 mole % of polyethylene glycol, 5 mole % of dimethyl-5-sulfoisothphalate, 5 mole % of isophthalic acid and 85 mole % of polyethylene terephthalate is fed as a sea component. And the island component and the sea component are conjugated spun and false twisted, for thereby producing a false twisted and dope dyed sea-island type conjugate yarn (after dissolving of a sea component, 36 islands per filament) of 75 denier/24 filaments. In the above conjugation spinning, the ratio of island component:sea component is 70% by weight:30% by weight. Continuously, a warp knit fabric having a density of 23 yarns/cm is produced using the false twisted and dope dyed sea-island type conjugate yarn as a face yarn and polyester filaments of 50 deniers/24 filaments as a back yarn. At this time, the weight ratio of face yarn:back yarn in the warp knit fabric is 45% by weight:55% by weight. The produced warp knit fabric is napped to be shrunken by 50%, then preset, and weight-reduced for 40 minutes in a NaOH solution having a concentration of 1% o.w.s and a temperature of 98° C., buffed and finally set at 180° C., thus producing a finished warp knit fabric. At this time, no dyeing is preformed. The results of evaluation of the processability and yarn physical properties are indicated in Table 1 and the results of evaluation of the quality properties of the warp knit fabric are indicated in Table 2.

EXAMPLE 2

A master batch chip, which is composed of 10% by weight of carbon black and 90% by weight of polyethylene terephthalate having an intrinsic viscosity of 0.64, is fed into a sub feed tube for an island component of an ordinary sea-island type conjugate spinning machine, and at the same time an island component chip of polyethylene terephthatate having an intrinsic viscosity of 0.64 is fed into an main feed tube for the island component. Then, these are melted and mixed at the front end of a melt-extruding machine, thus producing a final island component and then feeding it to the sea-island type conjugate spinning machine continuously. At this time, the weight ratio of the master batch chip to the island component chip is adjusted so that the carbon black content in the final island component is 3% by weight. Meanwhile, alkali easy soluble copolymerized polyester composed of 5 mole % of polyethylene glycol, 5 mole % of dimethyl-5-sulfoisothphalate, 5 mole % of isophthalic acid and 85 mole % of polyethylene terephthalate is fed as a sea component. And the island component and the sea component are conjugated spun and false twisted, for thereby producing a false twisted and dope dyed sea-island type conjugate yarn (after dissolving of a sea component, 36 islands per filament) of 75 denier/24 filaments. In the above conjugation spinning, the ratio of island component:sea component is 60% by weight:40% by weight. Continuously, a warp knit fabric having a density of 23 yarns/cm is produced using the false twisted and dope dyed sea-island type conjugate yarn as a face yarn and polyester filaments of 50 deniers/24 filaments as a back yarn. At this time, the weight ratio of face yarn:back yarn in the warp knit fabric is 45% by weight:55% by weight. The produced warp knit fabric is napped to be shrunken by 50%, then preset, and weight-reduced for 40 minutes in a NaOH solution having a concentration of 1% o.w.s and a temperature of 98° C., buffed and finally set at 180° C., thus producing a finished warp knit fabric. The finished warp knit fabric is dyed with a black disperse dyestuffs (2% o.w.f. concentration) by a typical rapid dyeing machine for 40 minutes at 120 TC (ph=4.5), is washed and then is finally set at 160° C. The results of evaluation of the processability and yarn physical properties are indicated in Table 1 and the results of evaluation of the quality properties of the finished warp knit fabric are indicated in Table 2.

EXAMPLE 3

A master batch chip, which is composed of 10% by weight of Papition Yellow S-4G (products by Eastwell Co., Ltd.), which is a dyestuffs, and polyethylene terephthalate of 90% by weight having an intrinsic viscosity of 0.64, is fed into a sub feed tube for an island component of an ordinary sea-island type conjugate spinning machine, and at the same time an island component chip of polyethylene terephthalate having an intrinsic viscosity of 0.64 is fed into an main feed tube for the island component. Then, these are melted and mixed at the front end of a melt-extruding machine, thus producing a final island component and then feeding it to the sea-island type conjugate spinning machine continuously. At this time, the weight ratio of the master batch chip to the island component chip is adjusted so that the dyestuffs content in the final island component is 5% by weight. Meanwhile, alkali easy soluble copolymerized polyester composed of 5 mole % of polyethylene glycol, 5 mole % of dimethyl-5-sulfoisothphalate, 5 mole % of isophthalic acid and 85 mole % of polyethylene terephthalate is fed as a sea component. And the island component and the sea component are conjugated spun and false twisted, for thereby producing a false twisted and dope dyed sea-island type conjugate yarn (after dissolving of a sea component, 36 islands per filament) of 75 denier/24 filaments. In the above conjugation spinning, the ratio of island component:sea component is 70% by weight:30% by weight. Continuously, a warp knit fabric having a density of 23 yarns/cm is produced using the false twisted and dope dyed sea-island type conjugate yarn as a face yarn and polyester filaments of 50 deniers/24 filaments as a back yarn. At this time, the weight ratio of face yarn:back yarn in the warp knit fabric is 45% by weight:55% by weight. The produced warp knit fabric is napped to be shrunken by 50%, then preset, and weight-reduced for 40 minutes in a NaOH solution having a concentration of 1% o.w.s and a temperature of 98° C., buffed and finally set at 180° C., thus producing a finished warp knit fabric. At this time, no dyeing process is performed. The results of evaluation of the processability and yarn physical properties are indicated in Table 1 and the results of evaluation of the quality properties of the finished warp knit fabric are indicated in Table 2.

EXAMPLE 4

A master batch chip, which is composed of 10% by weight of Heliogen Blue D 7030 (products by BASF.), which is a pigment, and polyethylene terephthalate of 90% by weight having an intrinsic viscosity of 0.64, is fed into a sub feed tube for an island component of an ordinary sea-island type conjugate spinning machine, and at the same time an island component chip of polyethylene terephthalate having an intrinsic viscosity of 0.64 is fed into an main feed tube for the island component. Then, these are melted and mixed at the front end of a melt-extruding machine, thus producing a final island component and then feeding it to the sea-island type conjugate spinning machine continuously. At this time, the weight ratio of the master batch chip to thee island component chip is adjusted so that the pigment content in the final island component is 5% by weight. Meanwhile, alkali easy soluble copolymerized polyester composed of 5 mole % of polyethylene glycol, 5 mole % of dimethyl-5-sulfoisothphalate, 5 mole % of isophthalic acid and 85 mole % of polyethylene terephthalate is fed as a sea component and the island component. And the sea component are conjugated spun, for thereby producing a dope dyed sea-island type conjugate multifilament of 150 denier/48 filaments, whose island component has a denier of 0.06. In the above conjugation spinning, the ratio of island component:sea component is 70% by weight:30% by weight. Continuously, the dope dyed sea-island type conjugate multifilament and a high shrinkage polyester yarn of 30 denier/12 filaments having a boiling water shrinkage rate of 18% are air mixed to thus produce a mixture filament yarn. Next, the dope dyed and air mixed filament yarn is fed as a face yarn into an interlock circular knitting machine with 18 dial gauges-4 races, and then polyester filaments (dope dyed yarn) of 50 denier/12 filaments containing 1.0% by weight of carbon black are fed as a back yarn thereinto, thereby producing a circular knit fabric. The produced circular knit fabric is weight-reduced for 30 minutes in a NaOH solution having a concentration of 1% o.w.s and a temperature of 98° C., buffed and finally set at 180° C., thus producing a finished circular knit fabric. At this time, no dyeing process is performed. The results of evaluation of the processability and yarn physical properties are indicated in Table 1 and the results of evaluation of the quality properties of the finished circular knit fabric are indicated in Table 2.

EXAMPLE 5

A master batch chip, which is composed of 10% by weight of carbon black and 90% by weight of polyethylene terephthalate having an intrinsic viscosity of 0.64, is fed into a sub feed tube for an island component of an ordinary sea-island type conjugate spinning machine, and at the same time an island component chip of polyethylene terephthalate having an intrinsic viscosity of 0.64 is fed into an main feed tube for the island component. Then, these are melted and mixed at the front end of a melt-extruding machine, thus producing a final island component and then feeding it to the sea-island type conjugate spinning machine continuously. At this time, the weight ratio of the master batch chip to thee island component chip is adjusted so that the carbon black content in the final island component is 3% by weight. Meanwhile, alkali easy soluble copolymerized polyester composed of 5 mole % of polyethylene glycol, 5 mole % of dimethyl-5-sulfoisothphalate, 5 mole % of isophthalic acid and 85 mole % of polyethylene terephthalate is fed as a sea component. And the island component and the sea component are conjugated spun, for thereby producing a dope dyed sea-island type conjugate multifilament of 150 denier/48 filaments, whose island component has a 0.06 denier. In the above conjugation spinning, the ratio of island component sea component is 70% by weight:30% by weight. Continuously, the dope dyed sea-island type conjugate multifilament and a high shrinkage polyester yarn of 30 denier/12 filaments having a boiling water shrinkage rate of 18% are air mixed to thus produce an air mixture filament yarn. Next, the air mixture filament yarn is fed as a weft and a false twisted polyester yarn (dope dyed yarn) of 75 denier/36 filaments containing 1.4% by weight of carbon black are fed as a warp, thereby producing a fabric of a satin weave having a warp density of 132 yarns/inch and a weft density of 128 yarns/inch in a rapier loom. The woven fabric is weight-reduced for 30 minutes in a NaOH solution having a concentration of 1% o.w.s and a temperature of 98° C., buffed and finally set at 180° C., thus producing a finished woven fabric. At this time, no dyeing process is performed. The results of evaluation of the processability and yarn physical properties are indicated in Table 1 and the results of evaluation of the quality properties of the finished woven fabric are indicated in Table 2.

COMPARATIVE EXAMPLE 1

Polyethylene terephthalate having an intrinsic viscosity of 0.64 as an island component (that does not contain a dope dyed component) is fed to an ordinary sea-island type conjugate spinning machine and alkali easy soluble copolymerized polyester composed of 5 mole % of polyethylene glycol, 5 mole % of dimethyl-5-sulfoisothphalate, 5 mole % of isophthalic acid and 85 mole % of polyethylene terephthalate as a sea component is fed thereto. Then the island component and the sea component are conjugated spun and false twisted, for thereby producing a false twisted and dope dyed sea-island type conjugate yarn (upon dissolving of the sea component, 36 islands per filament) of 75 denier/24 filaments. In the above conjugation spinning, the ratio of island component:sea component is 70% by weight:30% by weight. Continuously, a warp knit fabric having a density of 23 yarns/cm is produced using the false twisted and dope dyed sea-island type conjugate yarn as a face yarn and polyester filaments of 50 deniers/24 filaments as a back yarn. At this time, the weight ratio of face yarn:back yarn in the warp knit fabric is 45% by weight:55% by weight. The produced warp knit fabric is napped to be shrunken by 50%, then preset, and weight-reduced for 40 minutes in a NaOH solution having a concentration of 1% o.w.s and a temperature of 98° C., buffed and finally set at 180° C., thus producing a finished warp knit fabric. The finished warp knit fabric is dyed with a black disperse dyestuffs (2% o.w.f. concentration) by a typical rapid dyeing machine for 45 minutes at 120° C. (pH=4.5). The results of evaluation of the processability and yarn physical properties are indicated in Table 1 and the results of evaluation of the quality properties of the finished warp knit fabric are indicated in Table 2.

TABLE 1

Processability and yarn physical properties.

| Class | Spinnability (%) | False twisting propery (%) | Raising Property (%) | Tmax (° C.) | Tα (° C.) | Tβ (° C.) | Maximum Thermal Stress (g/d) |
|---|---|---|---|---|---|---|---|
| Example 1 | 97.5 | 87.5 | ⊙ | 162.5 | 141.3 | 191.3 | 0.200 |
| Example 2 | 98.5 | 96.4 | ⊙ | 153.5 | 140.5 | 180.3 | 0.201 |
| Example 3 | 98.5 | 95.3 | ⊙ | 160.6 | 145.5 | 181.1 | 0.192 |
| Example 4 | 94.5 | 95.5 | ⊙ | 176.5 | 158.3 | 196.3 | 0.215 |
| Example 5 | 96.5 | 94.1 | — | 162.5 | 151.3 | 193.0 | 0.210 |
| Comparative Example 1 | 98.7 | 63.4 | Δ | 153.5 | 115.4 | 175.5 | 0.310 |

TABLE 2

Results of evaluation of quality properties of finished warp knit fabric.

| class | Wash fastness | Light Fastness | L value before Dyeing | L value after Dyeing | Particle Diameter of dope dyed Component (μm) | Appearance |
|---|---|---|---|---|---|---|
| Example 1 | Level 5 | Level 7 | 13.6 | — | 0.023 | ⊙ |
| Example 2 | Level 5 | Level 6 | 15.5 | 14.1 | 0.021 | ⊙ |
| Example 3 | Level 5 | Level 7 | 15.5 | — | 0.0004 | ⊙ |
| Example 4 | Level 5 | Level 7 | 15.1 | — | 0.22 | ⊙ |
| Example 5 | Level 4 | Level 6 | 18.1 | — | 0.025 | ⊙ |
| Comparative Example 1 | Level 1–2 | Level 3 | 92.5 | 27.4 | — | Δ |

In the present invention, the quality properties of the warp knit fabric are evaluated by the following methods.

Wash Fastness

This was evaluated by the KS K 0430 A1 method.

Light Fastness

This was evaluated by the KS K 0700 method.

Blackness (L Value)

This was evaluated by using Spectra Flash 600 of Data Color company.

Raising Property and Appearance

An organoleptic test was carried out by 50 panellers. When 45 members or more judged that the sample was good, the fabric was evaluated to be good ⊙, when 20 to 44 members judged as above, the fabric was evaluated to be average (Δ), and when 20 members or more judged that the sample was poor, the fabric was evaluated to be poor (x).

Spinnability (%)

This is defined by the complete take-up ratio obtained during the production of 600 drums of 6 kg sea-island type conjugate multifilament.

False Twisting Processibility (%)

This is defined by the complete take-up ratio obtained during the production of 600 drums of 3 kg false twisted yarn using the sea-island type conjugate multifilament.

Average Particle Diameter of Dope Dyed Component and Cross-Sectional Area of Island Component Filaments The cross-section of a dope dyed sea-island type conjugate multifilament is photographed using a transmission electron microscope at a magnification of more than 1,000 times. On the photographed picture, the diameter of dope dyed particles is measured 30 times to thus obtain the average diameter. If the shape of the dope dyed component is abnormal, the particle diameter is obtained by following step. (i) measuring the major axis (a) and the minor axis (b). (ii) substituting the measured values for the following formula.

$$\text{Particle diameter}=\sqrt{\text{major axis(a)}\times\text{major axis(b)}}$$

Thermal Stress (Tg/Tmax/Maximum Thermal Stress)

This was measured by using a Kanebo thermal stress tester. Specifically, a 10 cm sample in a loop-like shape is latched to upper and lower end hooks. And then predetermined tension [total fineness (denier) of sea-island type conjugate multifilament×2/30g] is applied on the sample. In this state, the temperature is increased from R.T to 300° C. during 120 seconds. At this time, changes in stress according to changes in temperature is illustrated by a chart and then a temperature range (Tα–Tβ) are showing more than 95% of the maximum thermal stress is obtained(entering) around the point of the maximum thermal stress. Moreover, the maximum thermal stress per yarn denier is calculated by obtaining the maximum thermal stress on the chart and then substituting it for the following formula.

$$\text{Maximum thermal stress per denier}=$$

-continued $$\frac{\text{Maximum thermal stress}}{\text{Denier of sea-island type conjugate multifilament}} \times 100$$

INDUSTRIAL APPLICABILITY

As described above, the dope dyed sea-island type conjugate multifilament according to the present invention has excellent touch and appearance when producing a woven/knitted fabric, can obtain a desired color without an additional dyeing process and has very excellent wash fastness and light fastness. As the result, the dope dyed sea-island type conjugate multifilament of the present invention is useful for materials of artificial leathers or ladies' clothes. Furthermore, this invention could produce the conjugate multifilament with good spinnability.

What is claimed is:

1. A dope dyed sea-island type conjugate multifilament, which comprises easy soluble polymer as a sea component and polyester as an island component, wherein the island component includes a dope dyed component selected from the group consisting of carbon black, pigments and dyestuffs and the temperature range (Tα–Tβ) showing more than 95% of the maximum thermal stress of yarns is from 120° C. to 210° C.

2. The conjugate multifilament of claim 1, wherein the dope dyed component content in the island component is 0.1–15% by weight.

3. The conjugate multifilament of claim 1, wherein the average particle diameter of the dope dyed component contained in the island component is less than one-tenth of the filament diameter of the island component.

4. The conjugate multifilament of claim 1, wherein the average cross-sectional area of particles of the dope dyed component contained in the island component is less than one-twentieth of the filament cross-sectional area of the island component.

5. The conjugate multifilament of claim 1, wherein the average particle diameter of a non-easy soluble organic or inorganic pigment contained in the island component is 0.001 μm–0.55 μm.

6. The conjugate multifilament of claim 1, wherein the mono-filament fineness of the island component after dissolving the sea component is 0.001–0.3 denier.

7. The conjugate multifilament of claim 1, wherein the weight ratio of island component in the dope dyed sea-island type conjugate multifilament is 50–85% by weight and the weight ratio of the sea component is 15–50%.

8. The conjugate multifilament of claim 1, wherein the easy soluble polymer includes copolymerized polyester, polyvinylalcohol, polystyrene or the like.

9. The conjugate multifilament of claim 1, wherein the temperature range (Tα–Tβ) showing more than 95% of the maximum thermal stress of yarn is from 130° C. to 200° C.

10. A process of preparing a dope dyed sea-island type conjugate multifilament, which comprises a easy soluble polymer as a sea component and polyester as an island component, wherein the island component chip is fed into the main feed tube of a sea-island type conjugate spinning machine, a master batch chip, which includes a dope dyed component of 5–50 weight % selected from the group consisting of carbon black, pigments and dyestuffs, is fed into the sub feed tube for the island component of the sea-island type conjugate spinning machine, and then the island component chip and the master batch chip are melted and mixed at the inlet of a melt-extruding machine for the island component.

11. The process of claim 10, wherein the dope dyed component content in the island component is 0.1–15% by weight.

12. The process of claim 10, wherein the weight ratio of island component in the dope dyed sea-island type conjugate multifilament is 50–85% by weight and the weight ratio of the sea component is 15–50% by weight.

13. The process of claim 10, wherein the weight ratio of island component chip is 50–90% by weight and the weight ratio of master batch chip is 10–50% by weight.

14. The process of claim 10, wherein the average particle diameter of the dope dyed component contained in the island component is less than one-tenth of the filament diameter of the island component.

15. The process of claim 10, wherein the average cross-sectional area of particles of the dope dyed component contained in the island component is less than one-twentieth of the filament cross-sectional area of the island component.

16. The process of claim 10, wherein the average particle diameter of carbon black and organic or inorganic pigments contained in the island component is adjusted to 0.001 μm–0.55 μm.

17. A woven fabric which is woven from the dope dyed sea-island type conjugate multifilament of claim 1.

18. A knitted fabric which is knitted from the dope dyed sea-island type conjugate multifilament of claim 1.

* * * * *